United States Patent [19]

Haese

[11] 4,029,055

[45] June 14, 1977

[54] BOILER APPARATUS

[75] Inventor: Egon Haese, Bochum, Germany

[73] Assignee: Dr. C. Otto & Comp. G.m.b.H., Bochum, Germany

[22] Filed: Oct. 8, 1975

[21] Appl. No.: 620,558

[30] Foreign Application Priority Data

Oct. 11, 1974 Germany ..... 2448466

[52] U.S. Cl. ..... 122/32; 122/483; 165/135

[51] Int. Cl.[2] ..... F22B 1/02

[58] Field of Search ..... 122/32, 33, 34, 504, 122/483; 165/134, 135, 136

[56] References Cited

UNITED STATES PATENTS

| | | | |
|---|---|---|---|
| 3,110,288 | 11/1963 | Worley | 122/32 |
| 3,308,878 | 3/1967 | Durst et al. | 122/32 |
| 3,338,301 | 8/1967 | Romanos | 122/32 |
| 3,749,160 | 7/1973 | Vestre | 122/32 |

*Primary Examiner*—Kenneth W. Sprague
*Attorney, Agent, or Firm*—Brown, Murray, Flick & Peckham

[57] ABSTRACT

A boiler has an outer wall of weldable material and an inner chamber including a high temperature heat exchanger which is connected by pipes passing through openings in the outer boiler wall for the supply and discharge of a heat exchange medium. Each pipe for the heat exchange medium is spaced from and passes through a sleeve-like jacket that is welded to the outer boiler wall and projects outwardly therefrom. A cooling gas is fed into the sleeve-like jacket to pass along an annular space between the jacket and the pipe. The cooling gas flows into an annular chamber between the outer boiler wall and the inner chamber. According to a second embodiment, concentric sleeves are provided in the annular space between the jacket and pipe to pass the cooling gas to and fro within this space.

4 Claims, 3 Drawing Figures

BOILER APPARATUS

BACKGROUND OF THE INVENTION

This invention relates to a boiler having an outer wall of weldable material and spaced therefrom is an inner chamber wherein a heat exchange of gaseous media takes place at temperatures higher than the permissible operating temperature of the outer boiler wall. More particularly, the present invention relates to a construction and arrangement of parts to supply and discharge gaseous media for the inner chamber through the outer wall of such a boiler.

A boiler of this type is employed to transfer thermal energy by using a gaseous medium. The origin of thermal energy is the heat originating mainly from nuclear energy and conveyed through the medium of a noble gas. The temperatures to which the noble gas is heated by the nuclear energy are above the acceptable temperature, i.e., working temperature, for the weldable material forming the outer boiler wall. The boiler is conventionally constructed as a double-jacket unit to receive a flow of hot cooling gases from a nuclear reactor. In the boiler, the hot cooling gas flows around a reactor or heat exchanger situated within an inner boiler from where the gas flows upwardly through a cooler wherein, for example, steam is generated. While the hot cooling gas fed to the boiler has an entry temperature of about 950° C, the temperature of the gas drops below 400° C, e.g., to 250° C, after passing from the cooler. The cooler used to generate steam within the inner boiler is opened at its top so that the cooled noble gas can flow into an annular chamber located between the heat exchangers in the inner boiler and the outer boiler wall. A blower communicates with the annular chamber in the boiler at this point. In this way, the outer jacket of the boiler can be designed for passage of a noble gas at a lower temperature of, for example, 250° C. The usual or conventional operating pressure of the noble gas in the boiler is 50 bar.

A particular problem occurs in such a boiler where the conduit line leading to the inner boiler chamber for supplying and discharging gaseous media thereto must pass through the outer boiler wall which consists of weldable material. It is impossible to weld the conduit lines directly to the boiler wall because the required strength cannot be obtained since the boiler wall thickness is increased at this point to provide the required thermal conductivity. The conduit line has already been constructed in the form of a double-jacket tube assembly and the annular space between the tubes has been filled with thermally-insulating material. The layer of insulating material must be relatively thick, thus requiring an outer tube with a large diameter and in most cases additional reinforcement of the boiler wall is required. This is because there is a very large difference between the temperature of the gaseous media supplied and discharged by the pipes passing through the boiler wall and the acceptable operating temperature for the material forming the outer boiler wall. Moreover, a very large number of conduit lines is required to pass through a plane about the circumference of the boiler when cooling gases flow from a nuclear reactor into heat exchangers or reactors in a boiler. The number of required conduit lines is so great that the required pipe couplings, etc. connected thereto in a circumferential plane externally of the boiler contact one another even when the couplings are arranged in a staggered manner.

SUMMARY OF THE INVENTION

It is an object of the present invention to provide a construction and arrangement of parts including pipes for conducting gaseous media at a high temperature through an outer boiler wall to provide the required thermal insulation while at the same time enable the employment of smaller diameter pipes whereby a relatively large number of such pipes is disposed within a circumferential plane of the boiler without requiring reinforcement of the boiler wall.

According to the present invention, there is provided a boiler including the combination of an outer boiler wall consisting of weldable material, an inner boiler chamber including heat exchanger means spaced inwardly from the outer boiler wall in a manner to define an annular flow space for conducting a gaseous medium at a temperature lower than the temperature of the gaseous medium fed into the inner boiler chamber, a feed pipe to deliver the gaseous medium into the inner boiler chamber while forming a continuation of the annular flow space, the heat exchanger means having conduit means extending through openings in the outer boiler wall for supplying and discharging a gaseous medium at temperatures greater than the permissible operating temperature of the weldable material forming the outer boiler wall, each of the conduit means including a tube coupled to the heat exchanger means and extending from the aforesaid annular flow space through an opening in the outer boiler wall, a sleeve-like jacket welded to the outer boiler wall to project externally of the boiler in a surrounding relation with the tube to thereby define an annular jacket space between the jacket and the tube, and gas-conducting means for feeding a cooling gas along the annular jacket space into the aforesaid annular flow space without interfering with the process within the boiler.

The present invention further provides that the aforesaid annular jacket space is connected by conduits to conduct gases withdrawn from the aforesaid annular flow space after the pressure of the gas has been elevated by means of a compressor. By this arrangement of parts, a small part of the noble gas discharged from the boiler which has a relatively low temperature is circulated back into the boiler by passing through the aforementioned annular jacket space to thereby thermally insulate the tube conducting the heat exchanger gas from the jacket.

In the event that relatively long tubes are required to conduct the gaseous heat exchange medium from the boiler such as occurs, for example, when the boiler is enclosed in concrete, the aforementioned annular jacket space contains coaxial cylindrical sleeves that are secured at their opposite ends in such a manner that the gases fed through the annular jacket space pass to and fro repeatedly along the walls of the sleeves.

These features and advantages of the present invention as well as others will be more clearly understood when the following description is read in light of the accompanying drawings, in which.

Figure 1:
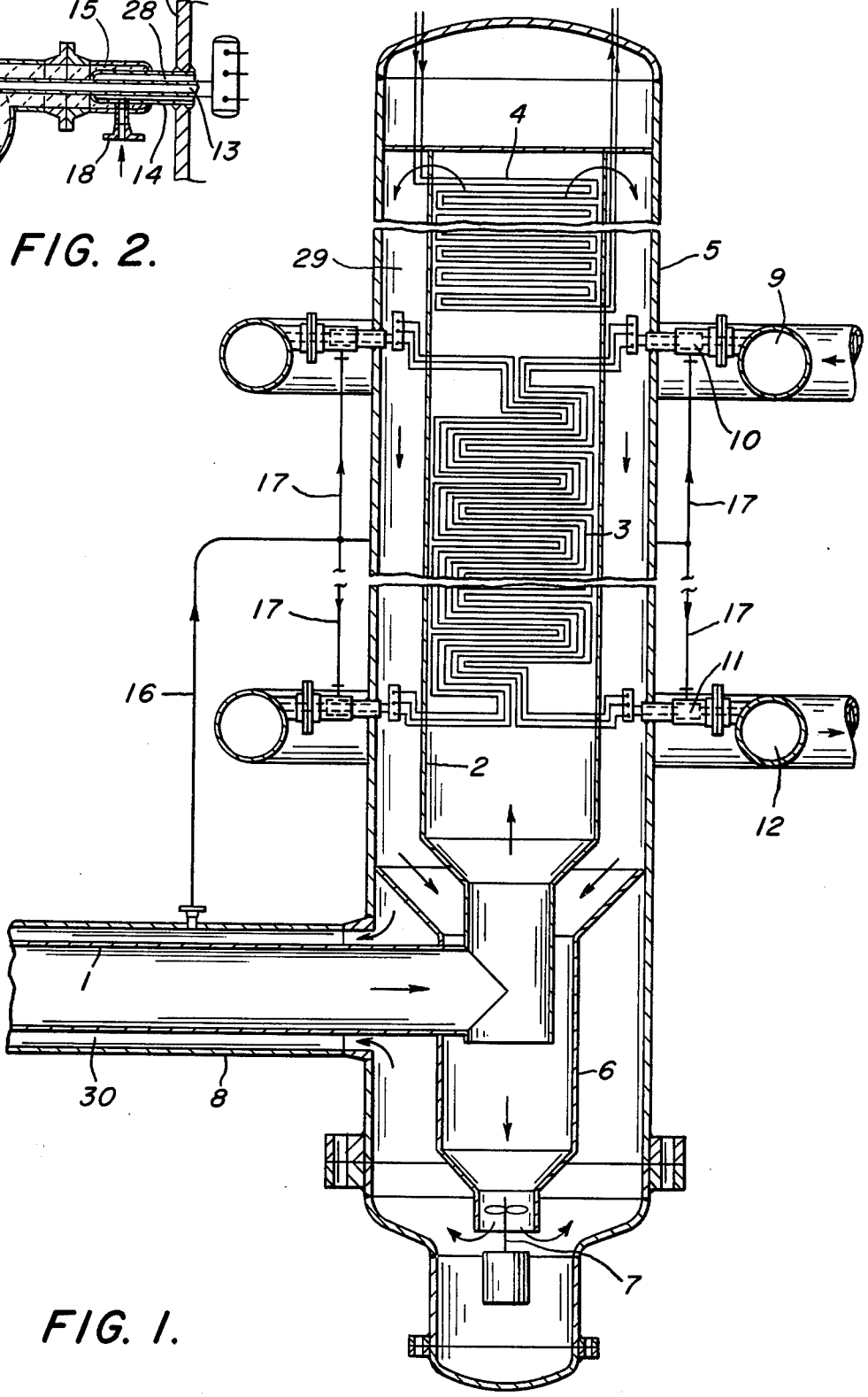
FIG. 1 illustrates a boiler-type heat exchanger apparatus embodying the features of the present invention.

The boiler shown in FIG. 1 is employed to heat a cracking gas and generate steam by receiving a noble gas used to carry the sensible heat produced in a nuclear reactor. The noble gas is conducted from the nuclear reactor through the inner pipe 1 at a temperature of about 1000° C and at a pressure of 40 bar. The noble gas enters the inner boiler chamber 2 of the boiler. Some of the heat of the noble gas is transferred to a cracking gas via a heat exchanger 3. The cracking gas is fed from a manifold or ring main 9 through a conduit assembly 10 at a temperature of 650° C. The cracking gas is withdrawn from the heat exchanger 3 at a temperature of about 870° C through a conduit assembly 11 into a manifold or ring main 12. The pressure of the cracking gas in the conduit pipes of the heat exchanger 3 is 40 bar.

The noble gas passed from the heat exchanger 3 of the boiler is cooled to a temperature of about 250° C in a cooler 4 which is actually operated as a steam generator. The noble gas, at a temperature of 250° C, then flows through an annular chamber 29 which lies between the inner boiler 2 and an outer boiler wall 5. The noble gas continues to pass downwardly and flows into an inner chamber formed by an apron 6 having a compressor 7 at its discharge end used to increase the pressure of the noble gas to a pressure which is 1–2 bar higher than the pressure of the noble gas in the annular chamber 29. The noble gas passed from the compressor 7 is returned to the nuclear reactor through an annular chamber 30 formed between an outer pipe 8 in a coaxial relation with the inner pipe 1. The outer boiler wall 5 and the pipe 8 are made from material which is restricted as to its use at elevated temperatures and pressures. This enables the employment of wall thicknesses for the boiler that are economically acceptable.

Figure 2:
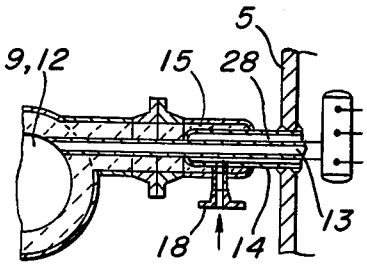
FIG. 2 is an enlarged view of a pipe assembly for passing a heat transfer medium externally of the boiler shown in FIG. 1.

The problem solved by the present invention is to provide a construction and arrangement of parts forming the conduit assemblies 10 and 11 to conduct the cracking gas from the heat exchanger 3 at a temperature which is higher than is acceptable for welding conduit pipes to the outer boiler wall 5. FIG. 2 shows a simplified arrangement of parts to form the conduit assemblies 10 and 11 used to pass cracking gas from the ring main 9 to the heat exchanger 3 and discharge the heated cracking gas from the heat exchanger 3 to the collector ring main 12. It is to be understood that the conduit assemblies 10 and 11 are constructed in the same manner. Tube 13 extends through an opening in the boiler wall 5. Tube 13 is surrounded by jacket tube 14 which is welded at one end to the outer boiler wall 5 and at the other end, jacket tube 14 is welded to the tube 13 at a location which is external of the boiler. Tube 13 passes through the boiler wall 5 into the annular chamber 29 where it is connected to a pigtail 3A of the heat exchanger 3. Tube 13 is connected at its other end to ring main 9 or 12. A jacket tube 15 is connected at one end to the jacket tube 14 and the annular chamber between jacket tubes 14 and 15 is filled with insulating material. The present invention makes use of the pressure gradient to the noble gas of 1–2 bar which is produced by the compressor 7. In this regard, the noble gas conducted by chamber 30 between the coaxial pipes 1 and 8 flows at a pressure of 1–2 bar greater than the pressure of the noble gas flowing downwardly along chamber 29 formed between the outer boiler wall 5 and the inner boiler 2. According to the present invention, a small amount of cooled noble gas is withdrawn from the annular chamber 30 and fed to pipe connection 18 by pipes 16 and 17. The cooled gas which is used as a flushing gas flows from the pipe connection 18 into the annular chamber 28 formed between the tube 13 and the jacket tube 14. The flushing gas then flows into the annular chamber 29 in the boiler where the gas expands. The flow of the flushing gas is selected so that the temperature of the jacket tube 14 is only slightly above the temperature of the boiler jacket 5. Thus, it is possible to employ a standard flange construction to form a pipe connection.

The above-described construction of the conduit assemblies 10 and 11 is suitable for a conduit assembly with a relatively short length and tube temperatures which do not exceed 750° C. Longer conduit lengths are required particularly when for safety reasons, the boiler is enclosed in a concrete jacket. There is also the need to pass gases at higher temperatures through the conduit assembly. In this event, the noble gas used as a flushing gas follows a multipath flow pattern in the annular chamber 28 according to the second embodiment of the present invention. This is clearly shown in FIG. 3 where the concrete jacket 26 encloses the boiler and requires conduit assemblies having a length of 1.5 meters or more to pass through the boiler wall. According to this embodiment, the jacket tube 14 is welded at its ends in the same manner as previously described, i.e., one end of the jacket tube 14 is welded to the boiler wall 5 and the other end of tube 14 is welded to the inner tube 13. Deflector tubes are constructed to form coaxially-arranged sleeves 19 and 20 that are located in the space between tubes 13 and 14 such that the flushing gas flowing through the pipe connection 18 must traverse the chambers 21, 22 and 23 formed by the spaced-apart walls of sleeves 19 and 20. The flow velocity of the flushing gas is selected so that the temperature at the end of chamber 21 is sufficiently low to enable the employment of a standard conduit assembly construction at the point where it is welded to the outer boiler wall 5.

Figure 3:
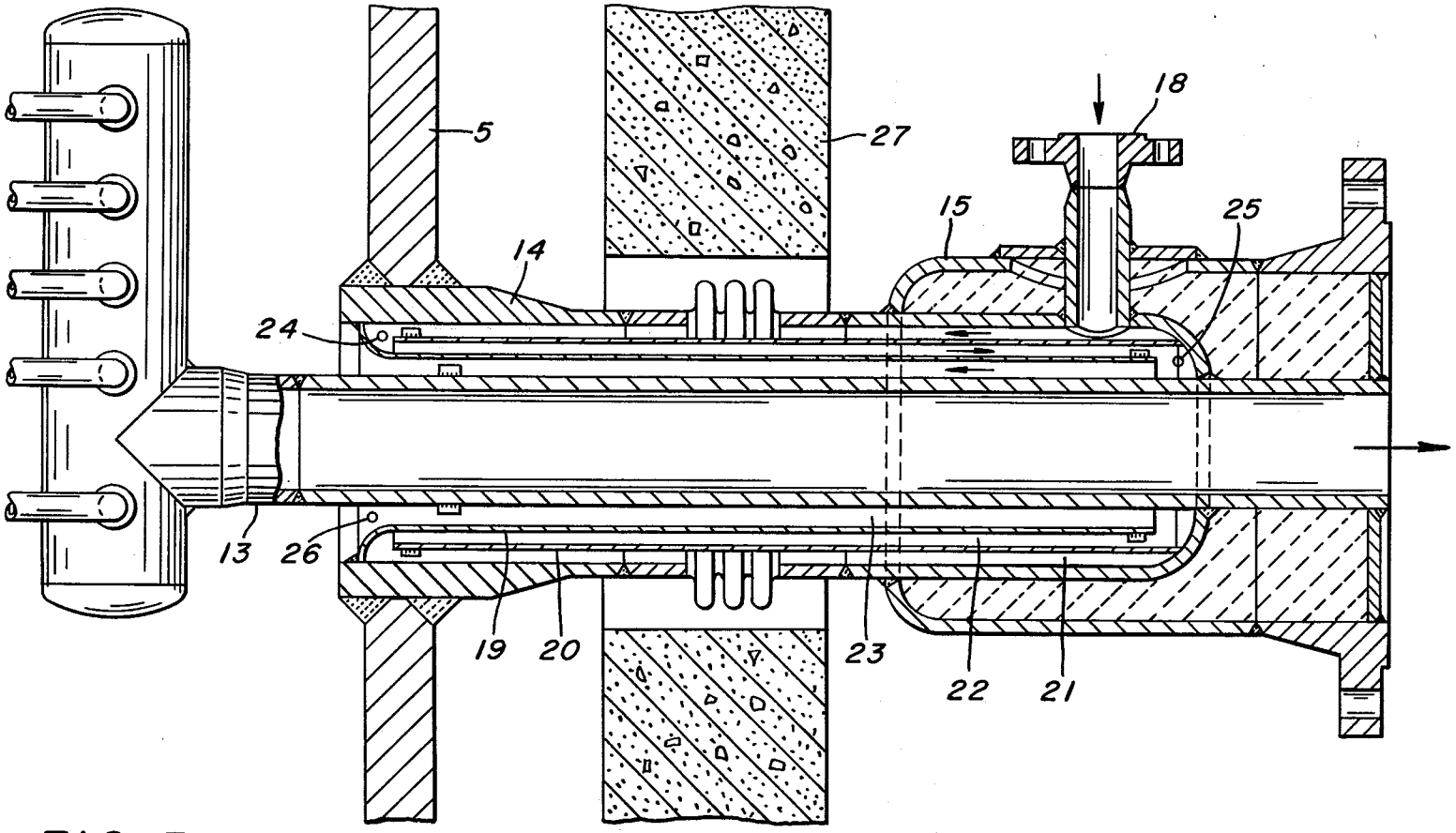
FIG. 3 is an enlarged view similar to FIG. 2 but illustrating a second embodiment of the present invention.

The following example demonstrates that the temperature at the circumference of the tubes of the conduit assembly is satisfactorily reduced by employing small amounts of flushing gas. In this example, there is a boiler forming a heat exchanger for superheating cracking gas. The outer diameter of the boiler is 3500 millimeters and has a flow of 1,145,000 $Nm^3/h$ of helium passing through the boiler. The pressure of the helium in the annular chamber 29 is 39 bar and the helium flowing in the annular space 30 after compression is 40.2 bar. The temperature of the helium in the annular chamber 30 is 250° C. The inlet and outlet of the heat exchanger 3 are connected by pigtails 3A each having 48 conduit assemblies embodying the construction as illustrated in FIG. 3. At the outlet side of the heat exchanger, the temperature of the heated medium in the tube 13 is 870° C. The diameter of the jacket tube 14 is 200 millimeters and the diameter of the tube 13 is 108 millimeters. The annular chamber between tubes 13 and 14 is divided into equal annular cross sections by deflector tubes 19 and 20. It is required that the flow of helium forming the flushing gas does not undergo a temperature increase greater than 2° C as a result of using the helium as a flushing gas. The flow of the flushing gas was varied and the temperatures of the gas at points 24, 25 and 26 were measured. Measurements were also taken to determine the heating of the total helium flow by the addition of the heated flushing gas. The test results are given in the following Table:

TABLE

| | Test No. 1 | Test No. 2 | Test No. 3 |
|---|---|---|---|
| Flushing gas flow per conduit assembly $Nm^3/h$ | 17 | 34 | 68 |
| Flushing gas flow for 48 conduit assemblies $Nm^3/h$ | 816 | 1632 | 3264 |
| Flushing gas flow in % of total helium flow | 0.07 | 0.014 | 0.28 |
| Temperature at point 24 in ° C | 430 | 291 | 263 |
| Temperature at point 25 in ° C | 465 | 350 | 300 |
| Temperature at point 26 in ° C | 755 | 639 | 525 |
| Temperature difference of total helium flow as a result of flushing gas supply in ° C | 0.36 | 0.55 | 0.78 |

Although the invention has been shown in connection with certain specific embodiments, it will be readily apparent to those skilled in the art that various changes in form and arrangement of parts may be made to suit requirements without departing from the spirit and scope of the invention.

I claim as my invention:

1. A boiler including the combination of an outer boiler wall consisting of weldable material, an inner chamber including heat exchanger means spaced inwardly from said outer boiler wall to thereby define an annular flow space for conducting a gaseous medium at a lower temperature than the temperature of the gaseous medium fed into said inner chamber, a feed pipe to deliver the gaseous medium into said inner chamber while forming a continuation of said annular flow space, conduit means coupled to said heat exchanger means and extending through openings in said outer boiler wall for supplying and discharging a gaseous medium at temperatures greater than the permissible operating temperature of the weldable material forming the outer boiler wall, each of said conduit means including a tube coupled to said heat exchanger means, said tube extending from said annular flow space through an opening in the outer boiler wall, a sleeve-like jacket welded to said outer boiler wall to project externally of the boiler in a surrounding relation with said tube to thereby define an annular jacket space between the jacket and the tube, and gas-conducting means for feeding a cooling gas along said annular jacket space to pass into said annular flow space without interfering with the process within the boiler.

2. The boiler according to claim 1 further comprising a compressor means for increasing the pressure of the gaseous media passing along the annular flow space surrounded by said feed pipe in relation to the pressure of the gaseous media passing along the outer boiler wall, and means for conducting pressurized gaseous media after discharge from said compressor means into said gas-conducting means.

3. The boiler according to claim 1 further comprising sleeves concentrically arranged within said annular jacket space, said sleeves having walls that are spaced from one another in such a manner to define gas flow spaces extending in opposite and parallel directions along the length of the sleeves.

4. The boiler according to claim 3 wherein the inner concentric sleeve is secured at one end to said sleeve-like jacket and the outer concentric sleeve is secured to said gas-conducting means at the end of the outer concentric sleeve which is opposite the secured end of the inner concentric sleeve.

* * * * *